United States Patent [19]

Lyons

[11] Patent Number: 4,958,797

[45] Date of Patent: Sep. 25, 1990

[54] COIN ROLL BREAK DEVICE FOR PROTECTING A TRAY WALL OF A COMPARTMENT OF A TILL TRAY

[75] Inventor: Dale R. Lyons, Buford, Ga.

[73] Assignee: NCR Corporation, Dayton, Ohio

[21] Appl. No.: 363,028

[22] Filed: Jun. 7, 1989

[51] Int. Cl.[5] ..... A47B 88/00

[52] U.S. Cl. ..... 248/345.1; 206/0.8

[58] Field of Search ..... 248/345.1; 235/7 R; 206/0.8

[56] References Cited

U.S. PATENT DOCUMENTS

| | | | |
|---|---|---|---|
| 2,564,386 | 8/1951 | Webb | 248/345.1 X |
| 3,358,725 | 12/1967 | Bussard et al. | 248/345.1 X |
| 4,109,887 | 8/1978 | Wakeland, Jr. | 248/345.1 |

*Primary Examiner*—Alvin C. Chin-Shue

*Attorney, Agent, or Firm*—Wilbert Hawk, Jr.; Albert L. Sessler, Jr.; Elmer Wargo

[57] ABSTRACT

A device for protecting a plastic tray wall of a compartment of a till tray when a user breaks a wrapper of a coin roll by impacting the coin roll against the tray wall. A generally U-shaped member, which is made of metal or plastic, is mounted on a tray wall of a plastic till tray while grippers located on opposed legs of the U-shaped member retain the member on the tray wall. A user then breaks the wrapper of the coin roll by impacting the coin roll against the U-shaped member, thereby releasing the coins for depositing into a compartment of the till tray. A second embodiment of the device includes a ridge formed thereon to facilitate breaking the wrapper of the coin roll.

5 Claims, 2 Drawing Sheets

COIN ROLL BREAK DEVICE FOR PROTECTING A TRAY WALL OF A COMPARTMENT OF A TILL TRAY

BACKGROUND OF THE INVENTION

1. Field of the Invention

This invention relates to a coin roll break device, and more particularly, it relates to a coin roll break bar for protecting a tray wall of a compartment of a till tray.

2. Description of Related Art

In recent years, the use of plastic till trays in business machines, such as Point of Sale (POS) terminals, for example, has become widespread. In general, plastic till trays are preferred over metal and wood till trays in the prior art because the plastic till trays are easier and more economical to manufacture.

Plastic till trays are placed inside a till drawer of a POS terminal, for example, and an operator may gain access to the coins and currency in the compartments of the till tray by opening the till drawer. During the course of a typical business day, it may be necessary for the operator to open a roll of coins in order to replenish the stock of coins in a compartment of the till tray. The operator may break the coin wrapper of the coin roll and release the coins therein by impacting the coin roll against one of the plastic tray walls of the till tray. The plastic tray wall of the till tray may break as a result of this impact.

A broken tray wall may prevent the operator from closing the POS terminal till drawer and may cause downtime of the terminal. In addition, the tray wall may be difficult to repair and may require that the entire till tray be replaced. Thus, a broken tray wall may cause a user to spend a considerable amount of time and expense before the POS terminal can properly function again.

SUMMARY OF THE INVENTION

In one aspect of this invention there is provided a till tray for use in a cash drawer of a business machine, said till tray comprising: at least one compartment with each compartment having a tray wall and with each tray wall having first and second opposed surfaces and an upper exposed edge joining the first and second opposed surfaces; and protection means mounted on the upper exposed edge of the tray wall of one of the at least one compartment which facilitates the breaking of a coin roll having a wrapper thereon and protecting the tray wall from damage when a user breaks open the coin roll by impacting the coin roll against the protection means; said protection means including a generally U-shaped body having a first leg portion, a second leg portion, and a joining portion having a striking surface joining the first and second leg portion, said striking surface being substantially rigid for breaking the wrapper of the coin roll when the coin roll is impacted thereagainst; said first leg portion and the second leg portion being resiliently biased towards each other so as to accommodate tray walls of varying thicknesses and to facilitate the protection means gripping the first and second opposed surfaces when the protection means is mounted on the upper exposed edge; and said first leg portion and the second leg portion each having a plurality of grippers thereon which become operatively engaged with the first and second opposed surfaces of the tray wall when the protection means is mounted on the upper exposed edge of the tray wall.

DESCRIPTION OF THE PREFERRED EMBODIMENT

Figure 1:
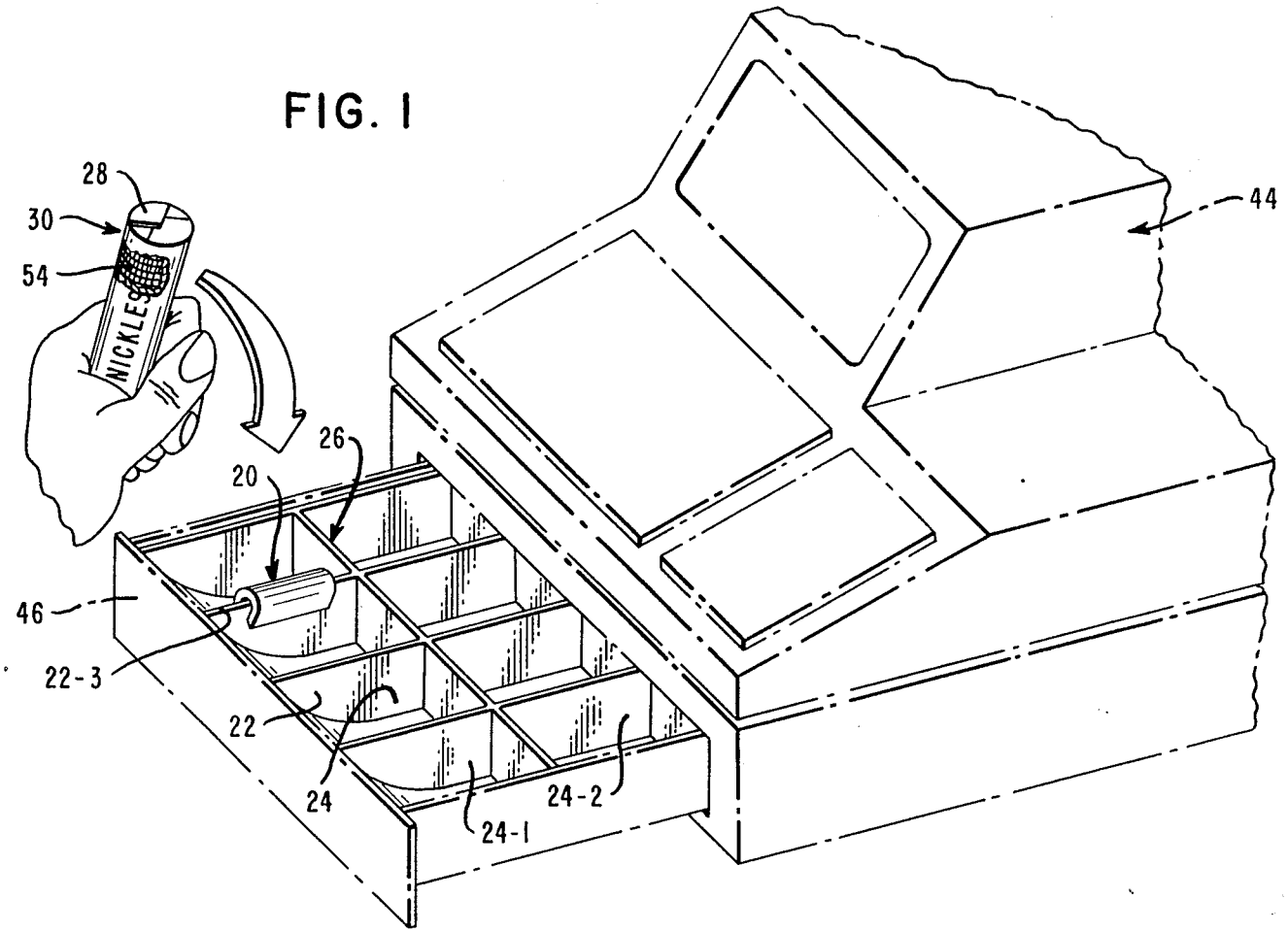
FIG. 1 is an isometric view showing a preferred embodiment of this invention in use on a till tray of a business machine.

FIG. 1 shows a typical environment in which this invention might be used. The invention includes a coin roll break bar, hereinafter designated as break bar 20. The primary function of the break bar 20 is to provide a means for protecting a tray wall 22 of a compartment 24 of a till tray 26 when a user breaks a wrapper 28 of a coin roll 30 by impacting the coin roll 30 against the tray wall 22. The break bar 20 also facilitates opening the coin roll 30 by providing the user with a hard striking surface 32-4 (FIG. 3) against which to impact the coin roll 30.

Figure 3:
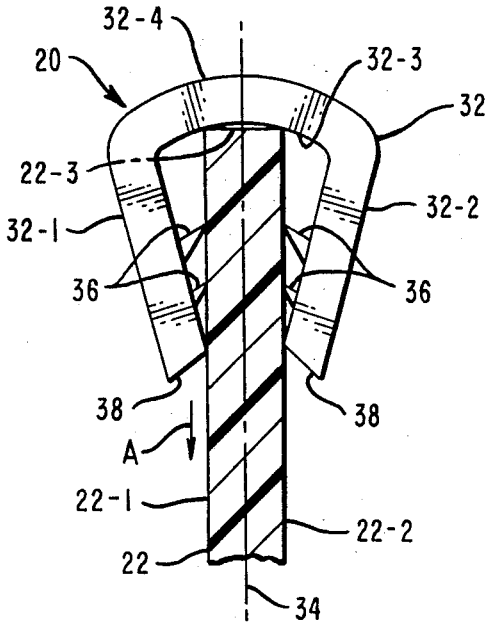
FIG. 3 is a sectional view taken along the line 3—3 of FIG. 2 showing the preferred embodiment of this invention mounted on the tray wall.

The break bar 20 is comprised of a generally U-shaped body 32 (FIG. 3) having a first leg portion 32-1, a second leg portion 32-2, and a joining portion 32-3 joining the first and second leg portions 32-1 and 32-2. The first leg portion 32-1 and second leg portion 32-2 are biased towards an imaginary plane, shown as dashed line 34, that bisects the U-shaped body 32 to produce symmetrical halves as shown in FIG. 3. As illustrated, the till tray 26 (FIG. 1) has at least one compartment 24 with each compartment 24 having the tray wall 22. Each tray wall 22 has first and second opposed surfaces, 22-1 and 22-2, respectively, which meet in a common upper edge 22-3, as shown in FIG. 3. The till tray 26 (FIG. 1) may include one or more coin compartments 24-1 and paper currency compartments 24-2.

Figure 2:
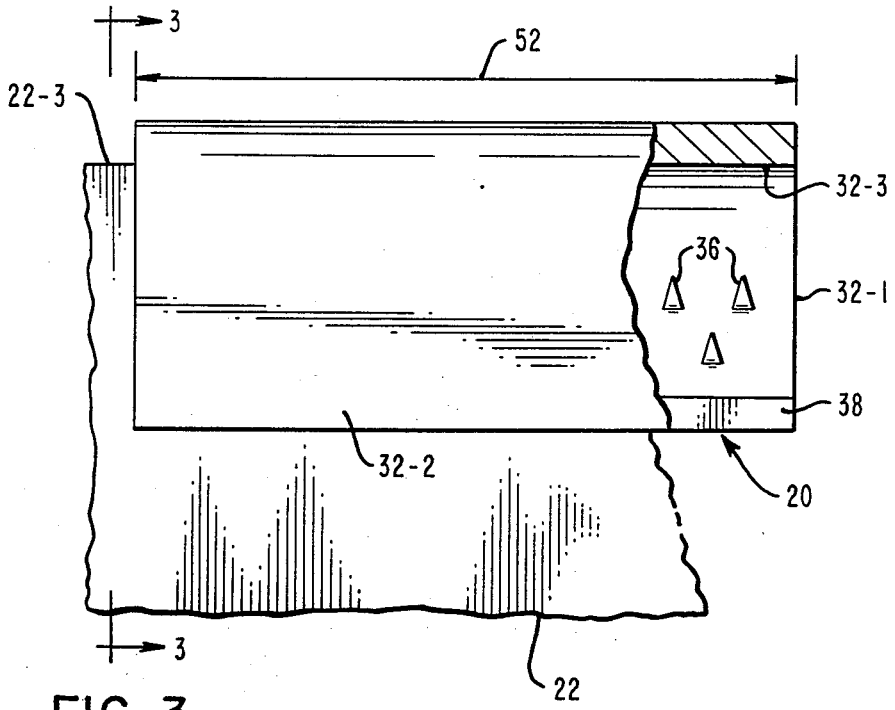
FIG. 2 is a fragmented view partly broken away to show a side of the invention and the grippers which facilitate gripping a tray wall of the till tray.

The first and second leg portions 32-1 and 32-2 are biased towards each other so as to accommodate tray walls 22 of varying thicknesses and to facilitate retaining the break bar 20 on the common upper edge 22-3 of the tray wall 22. In this regard, the first leg portion 32-1 and second leg portion 32-2 may include a plurality of grippers 36 (FIGS. 2 and 3). The grippers 36 on the first leg portion 32-1 and second leg portion 32-2 become operatively engaged with the first opposed surface 22-1 and the second opposed surface 22-2, respectively, of the tray wall 22 when the break bar 20 is positioned or mounted on the tray wall 22. The lower edges 38 of the first leg portion 32-1 and the second leg portion 32-2 are angled or beveled inwardly (FIG. 3) to facilitate sliding the break bar 20 onto the tray wall 22, as described later herein.

Figure 4:
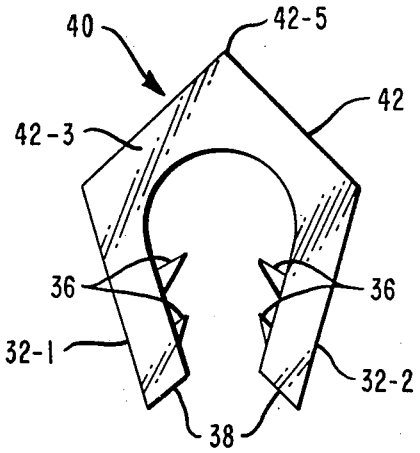
FIG. 4 is an end view of a second embodiment of this invention, showing the joining portion of the U-shaped body having a general, inverted "V" shape.

A second embodiment of this invention, designated generally as break bar 40, is best described in relation to FIG. 4. The break bar 40 includes the same part numbers for those parts of the break bar 40 that are identical to the parts of break bar 20; however, parts of the break bar 40 that are new or different from the parts of break bar 20 will be described with new part numbers as indicated herein. The U-shaped body 32 of the break bar 20 is replaced in FIG. 4 by a generally V-shaped body 42 of the break bar 40. As shown in FIG. 4, the joining portion 42-3 of the V-shaped body 42 has a sharp striking edge 42-5 to facilitate breaking the wrapper 28 (FIG. 1) of the coin roll 30 when the user impacts the coin roll 30 against the break bar 40.

The method for using the break bar of the present invention will now be described. In a business machine 44, such as a POS terminal, for example, the till tray 26 is placed inside a till drawer 46 of the business machine 44, as shown in FIG. 1. A user selects either the generally U-shaped break bar 20 or the V-shaped break bar 40. The user also selects one of the tray walls 22 of the compartment 24 of the till tray 26, and positions or mounts the selected break bar (hereinafter break bar 20) on the common upper edge 22-3 of the tray wall 22 (FIG. 3). The break bar 20 can be positioned towards the right or left side (as viewed in FIG. 1) of the till tray 26 in order to facilitate breaking the wrapper 28 of the coin roll 30 and directing the coins 54 into a preselected compartment 24. The resiliently biased first leg portion 32-1 and second leg portion 32-2 are "pushed" or "slid" onto the tray wall 22 in the direction of arrow A (FIG. 3). The grippers 36 on the first leg portion 32-1 and on the second leg portion 32-2 engage and grip the first opposed surface 22-1 and the second opposed surface 22-2, respectively, and restrict the break bar 20 from becoming dismounted from the tray wall 22. The break bar 20 preferably engages the common upper edge 22-3 when mounted thereon so that the joining portion 32-3 is supported on the common upper edge 22-3, as shown in FIG. 3. When a user desires to open the coin roll 30, he or she impacts the coin roll 30 against the striking surface 32-4 of the mounted break bar 20, thereby breaking the wrapper 28 and releasing the coins 54 in the coin roll 30 into the compartment 24 of the till tray 26. During such procedure the break bar 20 protects the tray wall 22 of the till tray 26 by distributing the force of the impact of the coin roll 30 against the break bar 20 along the length 52 (FIG. 2) of the U-shaped body 32 and along the common upper edge 22-3. After the wrapper 28 is broken, the user directs the coins 54 from the coin roll 30 into the appropriate preselected compartment 24 of the till tray 26. The break bar 20 can be removed from the tray wall 22 and stored inside one of the compartments 24, for example, or even moved to another tray wall 22. Alternatively, the break bar 20 can remain mounted on the tray wall 22 without interfering with the opening and closing of the till drawer 46.

The break bar 20 can be a one-piece construction and can be made of metal or molded from, for example, hard plastic. The break bar 20 has a typical length of 1.5 to 3 inches and a height of 0.375 to 1 inches. The first leg portion 32-1, the second leg portion 32-2, and the joining portion 32-3 have typical thicknesses of 0.1875 to 0.25 inches.

As stated previously herein, the functions of the break bar 20 are to facilitate opening the coin roll 30 and to protect the tray wall 22 of the compartment 24 of the till tray 26 when the user breaks the wrapper 28 of the coin roll 30 by impacting the coin roll 30 against the break bar 20 mounted on the tray wall 22.

The functional descriptions and dimensions described herein are merely illustrative and are not to be construed as limiting the scope of the invention. Various modifications and changes to the invention which do not depart from the spirit and scope of the invention as defined by the appended claims may occur to those skilled in the art.

What is claimed is:

1. A till tray for use in a cash drawer of a business machine, said till tray comprising:

at least one compartment with each compartment having a tray wall and with each tray wall having first and second opposed surfaces and an upper exposed edge joining said first and second opposed surfaces; and protection means mounted on said upper exposed edge of said tray wall of one of said at least one compartment which facilitates the breaking of a coin roll having a wrapper thereon and protecting said tray wall from damage when a user breaks open said coin roll by impacting said coin roll against said protection means;

said protection means including a generally U-shaped body having a first leg portion, a second leg portion, and a joining portion having a striking surface joining said first and second leg portions, said striking surface being substantially rigid for breaking the wrapper of the coin roll when the coin roll is impacted thereagainst;

said first leg portion and said second leg portion being resiliently biased towards each other so as to accommodate tray walls of varying thicknesses and to facilitate said protection means gripping said first and second opposed surfaces when said protection means is mounted on said upper exposed edge; and said first leg portion and said second leg portion each having a plurality of grippers thereon which become operatively engaged with the first and second opposed surfaces of said tray wall when said protection means is mounted on the upper exposed edge of said tray wall.

2. The till tray as claimed in claim 1 in which said joining portion has a U-shaped striking surface thereon to facilitate breaking the wrapper of said coin roll.

3. The till tray as claimed in claim 1 in which said joining portion has a V-shaped striking surface thereon to facilitate breaking the wrapper of said coin roll.

4. The till tray as claimed in claim 1 in which said body is made of metal.

5. The till tray as claimed in claim 1 in which said body is made of plastic.

* * * * *